US005564705A

United States Patent [19]

Kobayashi et al.

[11] Patent Number: 5,564,705

[45] Date of Patent: Oct. 15, 1996

[54] GOLF CLUB HEAD WITH PERIPHERAL BALANCE WEIGHTS

[75] Inventors: Kenji Kobayashi; Hitoshi Takeda, both of Tsubame, Japan

[73] Assignee: K.K. Endo Seisakusho, Japan

[21] Appl. No.: 250,431

[22] Filed: May 27, 1994

[30] Foreign Application Priority Data

| | | | |
|---|---|---|---|
| May 31, 1993 | [JP] | Japan | 5-129627 |
| Jul. 22, 1993 | [JP] | Japan | 5-181685 |
| Oct. 4, 1993 | [JP] | Japan | 5-248195 |
| Mar. 30, 1994 | [JP] | Japan | 6-061178 |

[51] Int. Cl.[6] ..... A63B 53/04

[52] U.S. Cl. ..... 473/334; 473/349; 473/350

[58] Field of Search ..... 273/169, 167 F, 273/170, 171, 172

[56] References Cited

U.S. PATENT DOCUMENTS

| | | | |
|---|---|---|---|
| 1,504,380 | 8/1924 | Reitenour | 273/168 |
| 1,538,312 | 5/1925 | Beat | 273/171 |
| 3,847,399 | 11/1974 | Raymont | 273/167 F |
| 3,955,820 | 5/1976 | Cochran et al. | 273/167 F |
| 4,213,613 | 7/1980 | Nygren | 273/169 |
| 4,919,431 | 4/1990 | Antonious | 273/169 |
| 5,439,223 | 8/1995 | Kobayashi | 273/169 |

*Primary Examiner*—William H. Grieb
*Attorney, Agent, or Firm*—Quarles & Brady

[57] ABSTRACT

An iron golf club head which enables the enlargement of so-called a sweet area. One or more balance weights are provided at one or both of peripheral portions both at a face and back side, thereby concentrating the weight distribution of a club head upon the peripheral portion relative to the face to enlarge a sweet area, which is further promoted by forming a cavity in the center of the back of the head body. Further, another weight may be also provided at a sole of the head body, thus lowering the center of gravity of a whole club head and enabling the easier upward-hitting of golf balls.

7 Claims, 15 Drawing Sheets

FIG. 4
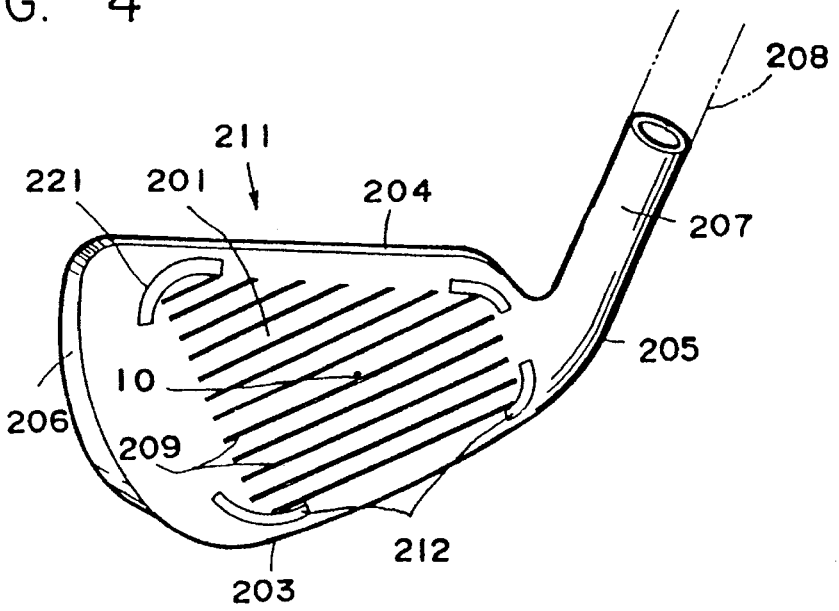
FIG. 5A
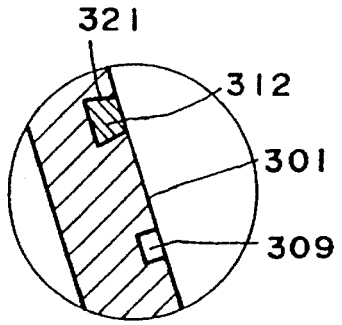
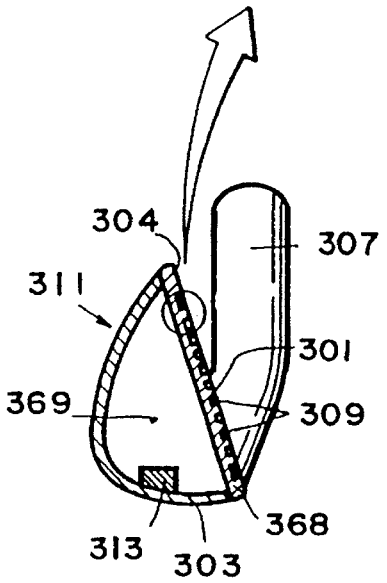
FIG. 5

GOLF CLUB HEAD WITH PERIPHERAL BALANCE WEIGHTS

BACKGROUND OF THE INVENTION (a) Field of the Invention

The present invention relates to a golf club head, especially relates to so-called an iron golf club head or a putter golf club head.

(b) Description of Prior Art

It is mainly for the purpose of enlarging so-called a sweet area and lowering the center of gravity of a golf club head that the weight distribution of a golf club head including an iron golf club head or the like is adjusted in an invention concerning a golf club head. It is obvious to those skilled in the art that to enlarge a sweet area, the center of gravity of a club head should be positioned comparatively backward, or else, the weight distribution of a golf club head should be concentrated upon a peripheral portion relative to a face besides the enlargement of a bulk of a golf club head itself. One of the representative of a means for realizing such weight distribution is disclosed in U.S. Pat. No. 3,847,399, in which a head body is formed hollow, or a back surface of a club head is formed with a cavity. On the other hand, it is mainly for the purpose of making a golf ball fly more upwardly and travel a longer distance to lower the center of gravity of a club head.

However, especially for an iron club head, it is difficult to make the same hollow. Further, only a cavity formed in a back surface of a club head made of a single material cannot sufficiently concentrate the weight distribution of a club head upon a peripheral portion, thus having a limitation in enlarging a sweet area.

SUMMARY OF THE INVENTION

It is, therefore, an object of the present invention to further enlarge a sweet area in a golf club head such as an iron golf club head.

According to a major feature of the present invention, a golf club head comrises: a head body having a back; a balance weight formed of a material denser than that of said head body, said balance weight being provided along a peripheral portion of the back of said head body, having a cavity surrounded by said balance weight at the back of said head body.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 4 is a perspective view showing a second embodiment of a golf club head of the invention.

FIG. 5 is a transverse sectional view showing a third embodiment of a golf club head of the present invention.

FIG. 5A is an enlarged view of a portion of FIG. 5.

DETAILED DESCRIPTION OF THE PREFERRED EMBODIMENTS

Figures 1, 1A:
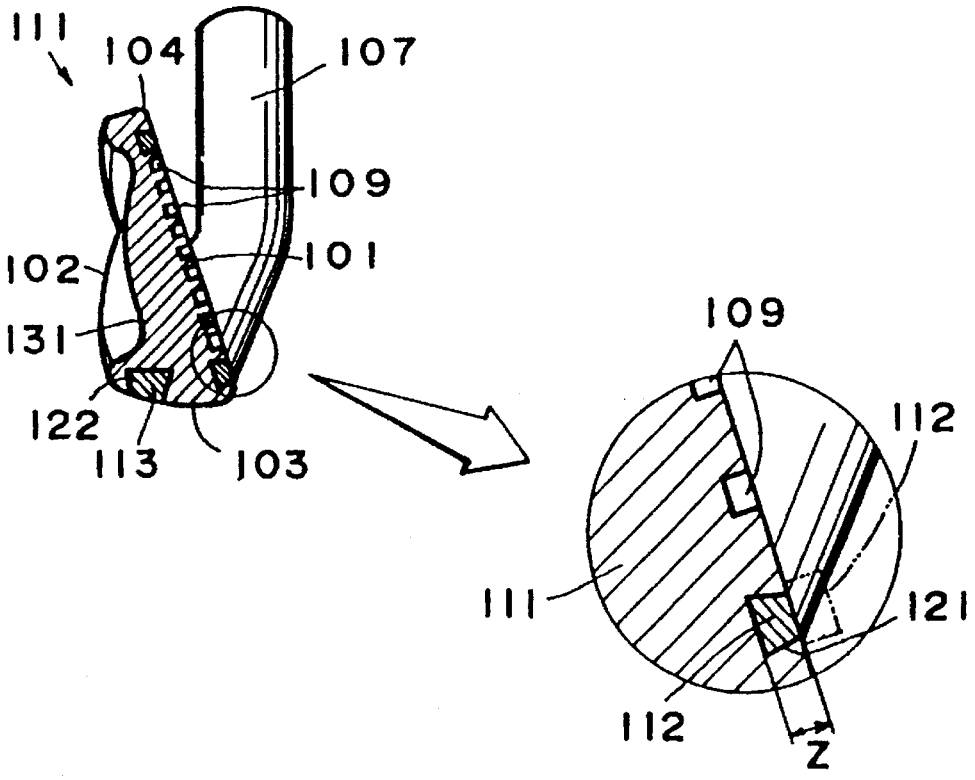
FIG. 1 is a transverse sectional view showing a first embodiment of a golf club head of the invention.
FIG. 1A is an enlarged view of a portion of FIG. 1.

Hereinafter are described embodiments of the present invention with reference to the drawings. All of the following embodiments relate to so called an "iron" golf club head except a tenth embodiment. In reference numerals attached to the drawings, 3 and 4-digit numbers show the number of embodiments, while for 1 and 2-digit numbers, the same portions in each embodiment are designated at common numerals, thus the repeated description will be suitably omitted on or after the description of a second embodiment.

Figure 2:
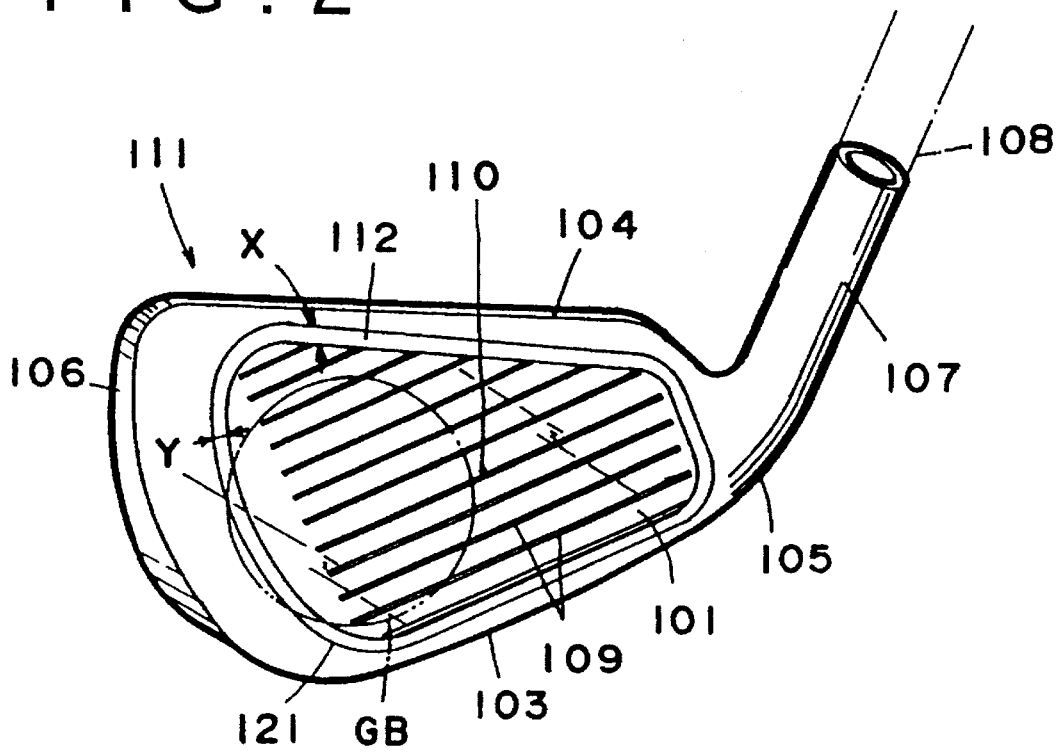
FIG. 2 is a perspective view showing a first embodiment of a golf club head of the invention.
Figure 3:
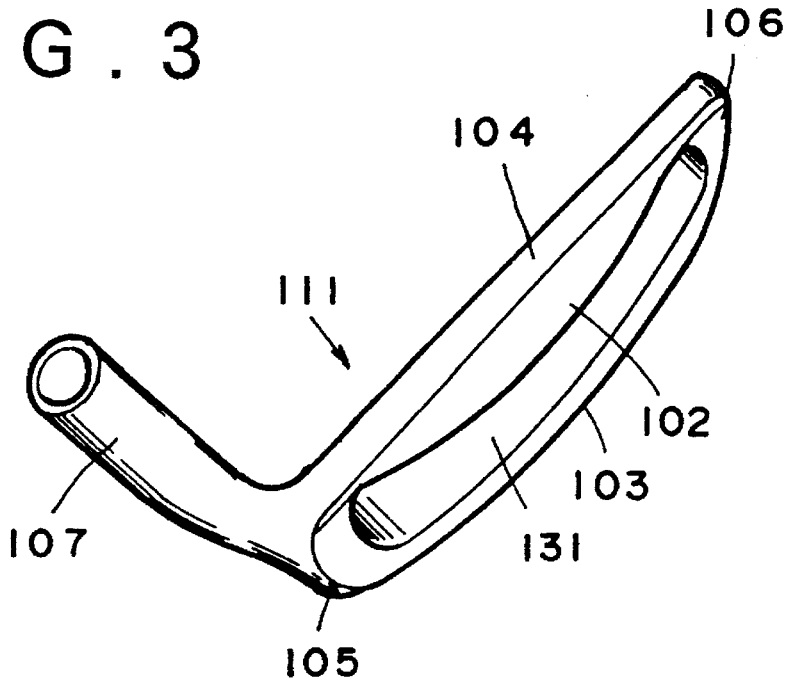
FIG. 3 is a rear perspective view showing a first embodiment of a golf club head of the invention.

In FIGS. 1 to 3 showing a first embodiment of the invention, reference numeral 101 designates a front face, while 102 designates a back, 103 a sole, 104 a top, 105 a heel at one side, 106 a toe at the other side respectively. From an upper portion of the heel 105, there extends obliquely upward a hosel 107, to which is connected a shaft 108. The face 101 is provided with grooves 109.

A golf club head shown in this embodiment comprises a head body 111 and balance weights 112, 113 embedded therein. The head body 111 forms approximately an entire portion of the golf club head, which is formed of metallic material having comparatively a small specific gravity, such as pure titanium, titanium alloy or aluminum alloy. On the other hand, the weights 112, 113 are formed of metallic material denser than that of the head body 111 such as iron, stainless steel, beryllium copper alloy or other copper alloy.

The head body 111 has an annular embedding groove 121 around a peripheral portion of the face 101, and another embedding groove 122 along a longitudinal length of the sole 103. These embedding grooves generally increase the widths toward its deep directions, i.e., they are formed reverse-tapered. And into the embedding groove 121 at the face 101 side is embedded the annular weight 112 in order to be secured thereto. In its fixing, as shown in a two-dotted line of FIG. 1, the annular weight 112 is placed on the embedding groove 121 for cold press fitting by a pressing device or the like. Whereas, into the embedding groove 122 formed approximately in a straight line at the sole 103 side is embedded the weight 113, which is also press-fitted by means of cold press fitting by a pressing device. As the embedding grooves 121,122 are dovetail-shaped, the weights 112,113 can be firmly secured to the head body 111.

Incidentally, a vertical width X of the weight 112 is 2 to 6 mm, preferably 4 mm, while its lateral width Y 5 to 10 mm, preferably 8 mm. And its thickness Z is 1 to 5 mm, preferably 3 mm, while a rate of the weight 112 to the whole club head is 20 to 50%, preferably 30% by weight. Further, there is provided a concave cavity 131 formed at a back side of the head body 111.

In accordance with the structure shown in a first embodiment, the weight distribution of a golf club head can be concentrated upon a peripheral portion relative to the face 101, owing to the cavity 131 and the weight 112 provided at the peripheral part of the face 101 side, thereby enlarging a sweet spot. Further, as shown in FIG. 2, a golf ball GB can travel a long distance if hit slightly off a center point 110 of the face 101. Furthermore, owing to the weight 113 provided in the sole 103 of the head body 111, the center of gravity of the whole club head can be positioned backward and low, whereby a further enlarged sweet spot can be obtained, and that hit balls can more easily fly upward.

In FIG. 4 showing a second embodiment of the invention, four corners of the face 201 of the head body 211 are formed with embedding grooves 221 respectively, into which are press-fitted weights 212.

In FIG. 5 showing a third embodiment of the invention, a golf club head is formed hollow. That is, a head body 311 is formed by welding a back crust member 369 to a back side of a face member 368 defining a face 301. Into an embedding groove 321 formed at a peripheral portion at the face 301 side is press-fitted a weight 312, while to a sole 303 within the back crust member 369 is welded another weight 313.

Figure 6:
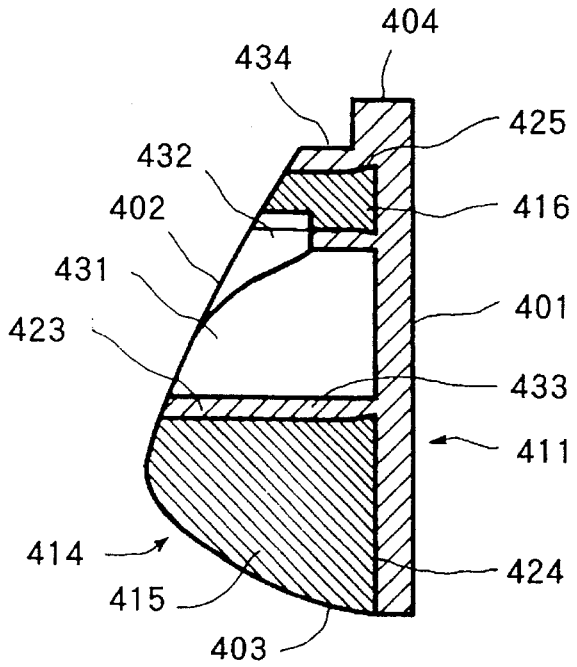
FIG. 6 is a transverse sectional view showing a fourth embodiment of a golf club head of the present invention.
Figure 7:
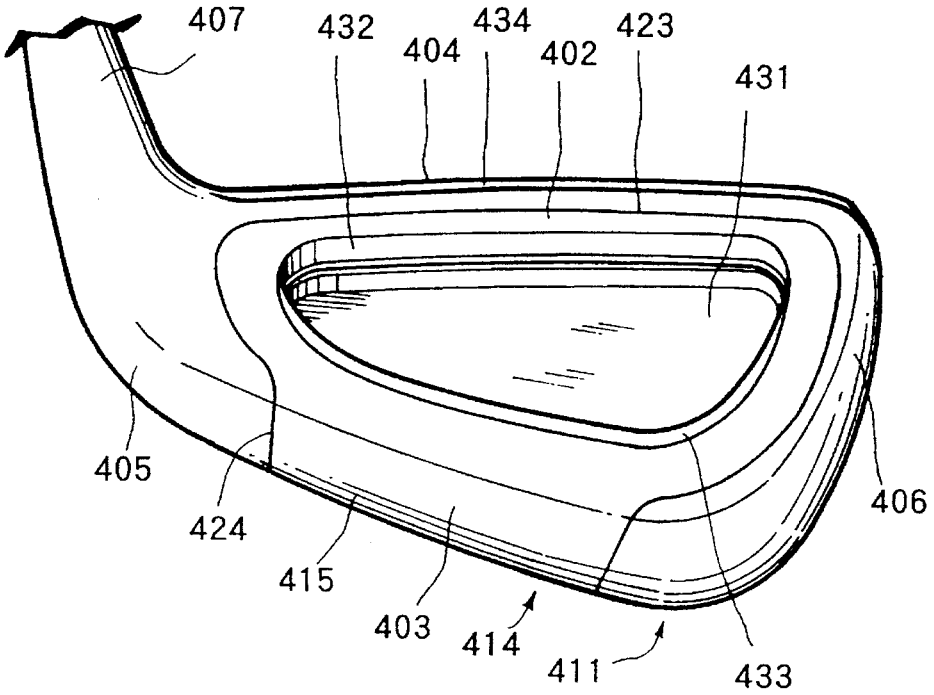
FIG. 7 is a perspective view showing a fourth embodiment of a golf club head of the invention.
Figure 8:
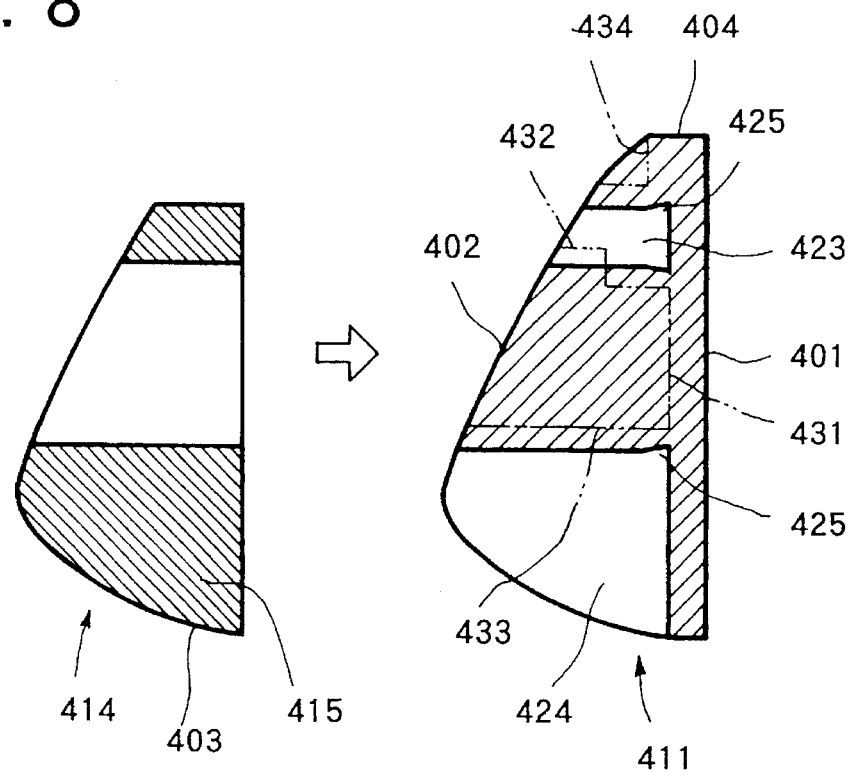
FIG. 8 is a transverse section showing a fourth embodiment of a golf club head of the invention, illustrating a manufacturing method of a golf club head.

In FIGS. 6 to 8 showing a fourth embodiment of the invention, there is also provided an annular concave embedding groove 423 in a peripheral portion at a back 402 side of a head body 411, which embedding groove 423 has an extension 424 extending toward a sole 403. A bottom portion of the embedding groove 423 adjacent face 401 side increases its width toward the front direction, i.e., having a dovetail-shaped portion 425. Into the embedding groove 423 is press-fitted an annular weight 414, which is provided with a weight-sole portion 415 fitted into the extension 424 of the embedding groove 423, defining a sole 403 of a golf club head. Further, the weight 414 has a thickened portion 416 fitted into the dovetail-shaped portion 425 of the embedding groove 423, thereby ensuring the securing of the head body 411 to the weight 414.

In addition, surrounded by the annular weight 414, there is provided a concave cavity 431 at the back 402 side of the head body 411. The upper portion of the back of the cavity 431 is formed with an elongated recess 432 extending up to a region of the weight 414. Concerning the other portion thereof, however, there is provided a cover portion 433 integral with the head body 411, contacting an inner peripheral surface of the weight 414. Further, above an upper portion of the weight 414, there is provided a step-formed recess 434 at the back side of the head body 411.

Hereinafter is described a manufacturing method of a golf club head shown in the embodiment with reference to FIG. 8.

The head body 411 is basically formed by forging. At the same time or after that is formed the embedding groove 423, while the weight 414 is formed by forging as well. As shown in an arrow, the weight 414 is pressed into the embedding groove 423 of the head body 411 by cold press-fitting, whereby a distal end of the weight 414 is subjected to a plastic deformation, thus forming the widened portion 416 fitted into the dovetail-shaped portion 425 of the embedding groove 423. After that, the cavity 431, elongated recess 432 and step-formed recess 434 are formed by milling with a machining center, as shown in a chain line. A removing amount at this stage of milling should be nearly 20 g.

With the structure shown in a fourth embodiment, as the denser weight is embedded into the peripheral portion at the back 402 side of the head body 411, having the cavity 431 provided in the center of the back 402 side of the head body 411, the center of gravity of a club head can be positioned still backward, with the weight distribution of a club head being concentrated upon the peripheral portion relative to the face 401 in spite of keeping a weight of the whole club head within a regular value. Further, as the weight 414 forms the sole 403, the center of gravity of the whole club head can be further positioned backward. Furthermore, the upper portion of the head body 411 is formed with the elongated recess 432 and step-formed recess 434, whereby the center of gravity of a club head can be still lowered. In the above-mentioned manner, a sweet area of a club head can be greatly enlarged.

In addition, as the cavity 431 is formed by machining after the press-fitting of the weight 414 into the embedding groove 423 of the head body 411, a cover portion 433 of the head body 411 contacting an inner periphery of the weight 414 can be formed thinner, thus enabling the enlarging of the cavity 431. That is because: assuming that a cavity is pre-formed at the back side of a head body prior to the embedding of a weight, a cover portion between a cavity and an embedding groove must be thickened to a certain extent in terms of its strength. Accordingly, a cavity cannot be sufficiently enlarged. However, the cavity 431 can be provided so as to be as closely to the weight 414 as you like by machining the cavity 431 after the press-fitting of the weight 414. Therefore, such enlargement of the cavity 431 makes the aforesaid weight distribution more effective. Further, the adjustment of machining position or amount enables the easy adjustment of the weight distribution of a club head in fabrication.

Incidentally, the same method can be applied to each embodiment described below.

Figure 9:
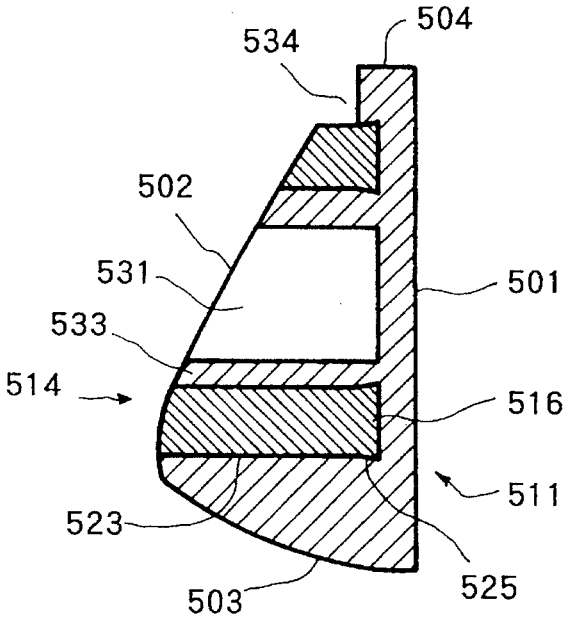
FIG. 9 is a transverse section showing a fifth embodiment of a golf club head of the invention.

In FIG. 9 showing a fifth embodiment of the invention, a sole 503 is formed by a head body 511 instead of an annular weight 514. Though the center of gravity can be lowerd further in accordance with a fourth embodiment, a fifth embodiment is advantageous in that as the weight 514 and embedding groove 523 are more simply shaped, they can be more easily machined.

Figure 10:
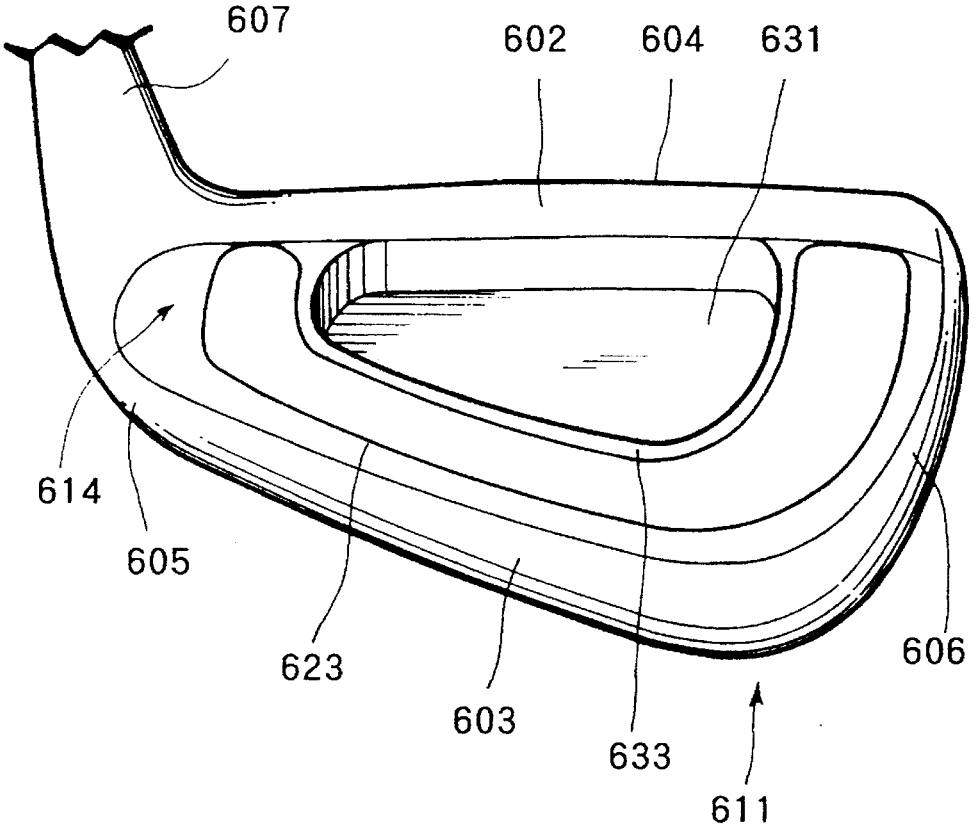
FIG. 10 is a perspective view showing a sixth embodiment of a golf club head of the invention.

In FIG. 10 showing a sixth embodiment of the invention, both an embedding groove 623 of a head body 611 and a weight 614 are formed semi-annular, which are positioned only at a sole 603, heel 605 and toe 606 side, not at a top 604 side, thereby positioning the center of gravity of a club head low and backward.

Figure 11:
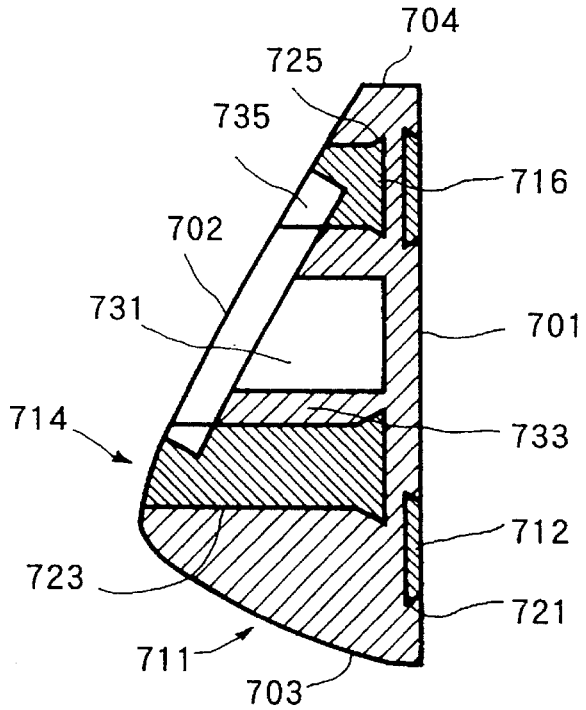
FIG. 11 is a transverse section showing a seventh embodiment of a golf club head of the invention.
Figure 12:
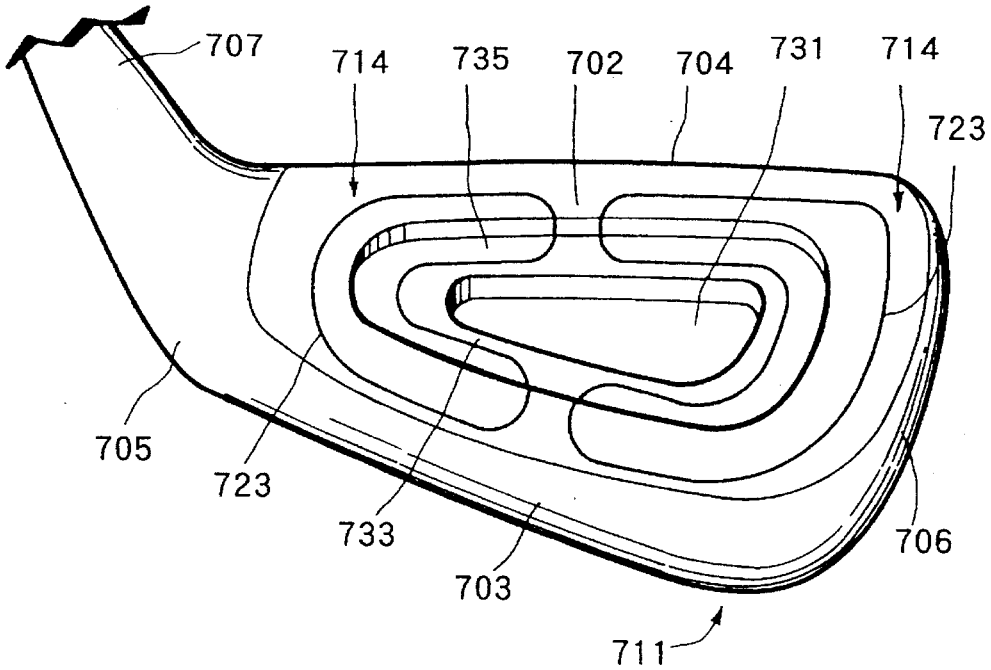
FIG. 12 is a perspective view showing a seventh embodiment of a golf club head of the invention.

In FIGS. 11 to 12 showing a seventh embodiment of the invention, in an almost entire area of a peripheral portion of a back 702 side of a head body 711 is provided a weight 714, which is divided into two parts designated at the same numeral, at a heel 705 and a toe 706 side respectively. That is, there are provided a pair of semi-annular weights 714, which are press-fitted into a pair of corresponding embedding grooves 723 formed in the head body 711. Additionally, a back of a cavity 731 is formed with a wide recess 735, of which the inner periphery becomes a part of that of the cavity 731. That is, the wide recess 735 is also machined after the press-fitting of the weight 714 into the head body 711, at this time, the inner periperal portion of its back is removed as well. Similarly to a first embodiment, there is provided an annular weight 712 at a peripheral portion of a face 701 of the head body 711.

According to the structure shown in a seventh embodiment, as the weight 714 is divided into two parts at the heel 705 and the toe 706 side respectively, the weight of a whole club head can be positively distributed at the above sides, thereby further stabilizing a travelling direction of golf balls. Further, any configuraions and sizes of the cavity 731 can be suitably chosen by forming the above-mentioned wide recess 735, whereby enabling the adjusting of the weight distribution of a club head in fabrication thereof.

Figure 13:
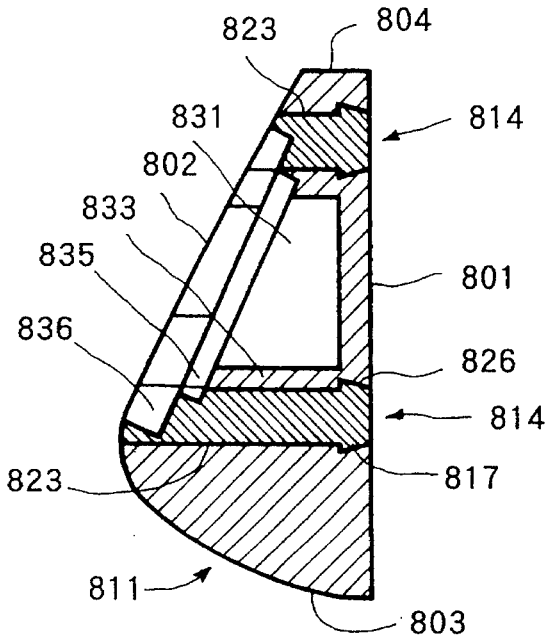
FIG. 13 is a transverse section showing an eighth embodiment of a golf club head of the invention.
Figure 14:
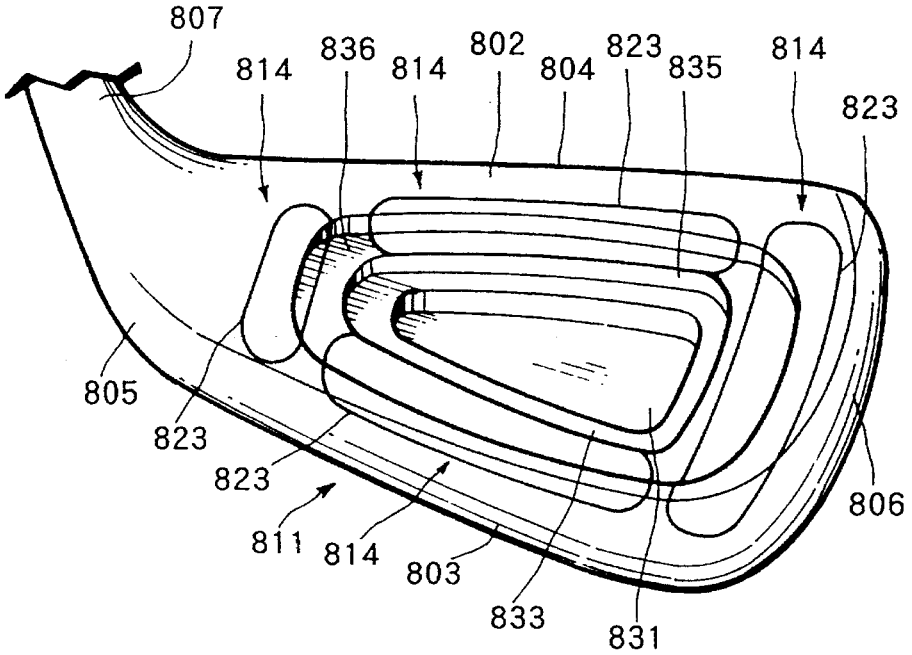
FIG. 14 is a perspective view showing an eighth embodiment of a golf club head of the invention.

In FIGS. 13 to 14 showing an eighth embodiment of the invention, a weight 814 is divided into four parts at sole 803, a top 804, a heel 805 and a toe 806 sides respectively. Four weights designated at the same numeral are formed tabular respectively. On the other hand, four embedding grooves 823 corresponding to the four weights 814 penetrate from a back 802 of a head body 811 through a face 801 thereof. As shown in FIG. 13, there is provided each wedge-shaped portion 826 of each embedding groove 823 adjacent the face 801 side. Each of the wedge-shaped portion 826 has a vertical surface at its back, while it tapers toward the front direction so that a wedge portion 817 of a distal end of the weight 814 may be fitted into the corresponding embedding groove for preventing the weight 814 from being loosened. Further, similarly to a seventh embodiment, a cavity 831 provided at a back 802 side of the head body 811 has wide recesses 835, 836, which, in this embodiment, are two-step-formed.

In fabrication, each weight 814 is press-fitted from the back into each corresponding embedding groove 823 of the head body 811. At this time, each weight 814 is struck at a support plate (not shown) provided at the face 801 side, whereby the distal end of the weight 814 is subjected to a plastic deformation to form the wedge-shaped portion 817 fitted into each wedge-shaped portion 826 of each embedding groove 823. The cavity 831, of course, is machined thereafter.

According to the structure shown in an eighth embodiment, as each weight 814 penetrates from the back 802 through the face 801, the weight distribution of a club head can be still concentrated upon the peripheral portion relative to the face 801.

Figure 15:
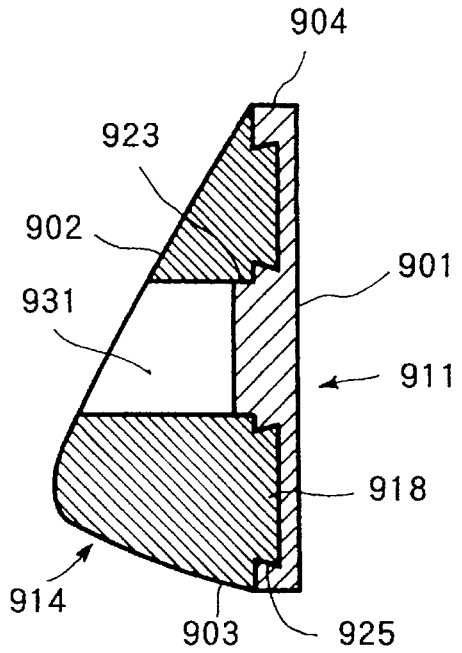
FIG. 15 is a transverse section showing a ninth embodiment of a golf club head of the invention.
Figure 16:
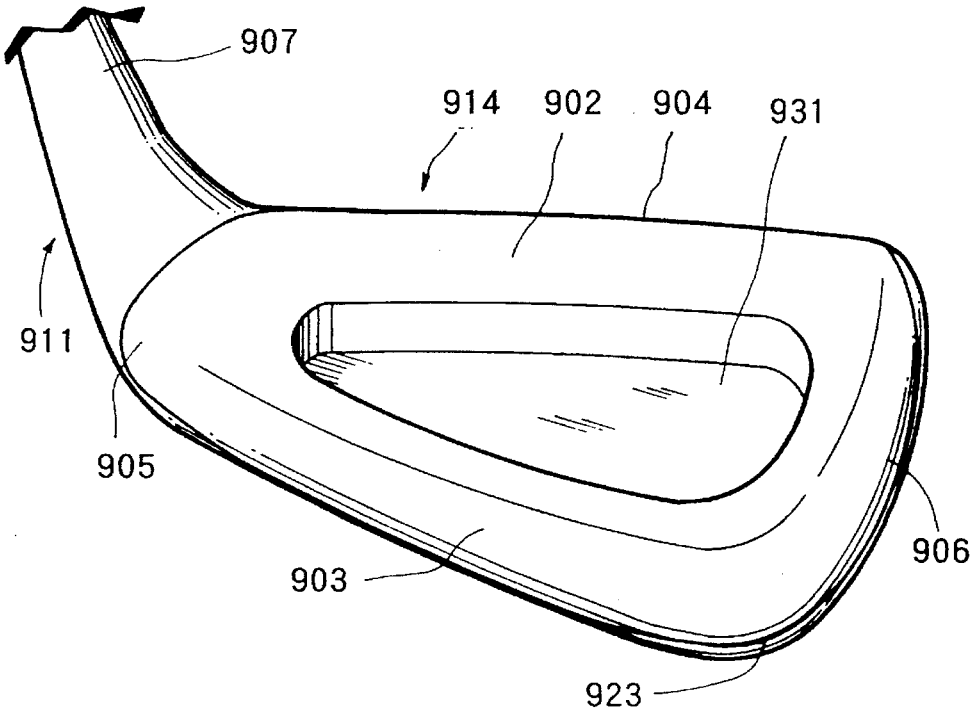
FIG. 16 is a perspective view showing a ninth embodiment of a golf club head of the invention.

In FIGS. 15 to 16 showing a ninth embodiment of the inventon, nearly a whole portion of a back 902 side of a club head including a sole 903 is constructed by an annular weight 914. Accordingly, an embedding groove 923 for press-fitting the weight 914 thereinto is step-formed at a peripheral portion of the back 902 side of the head body 911. On the other hand, to firmly secure the weight 914 to the head body 901, there is provided a dovetail groove 925 provided in a bottom surface of the embedding groove 923, into which is press-fitted a protrusion 918 formed on a front surface of the weight 914 with the same being subjected to a plastic deformation.

With the structure thus made, as approximately a whole portion of the back 902 side of a golf club head is constructed by the annular weight 914, the center of gravity of a club head can be positioned further backward, and that the weight distribution thereof can be further concentrated upon its peipheral portion.

Figure 17:
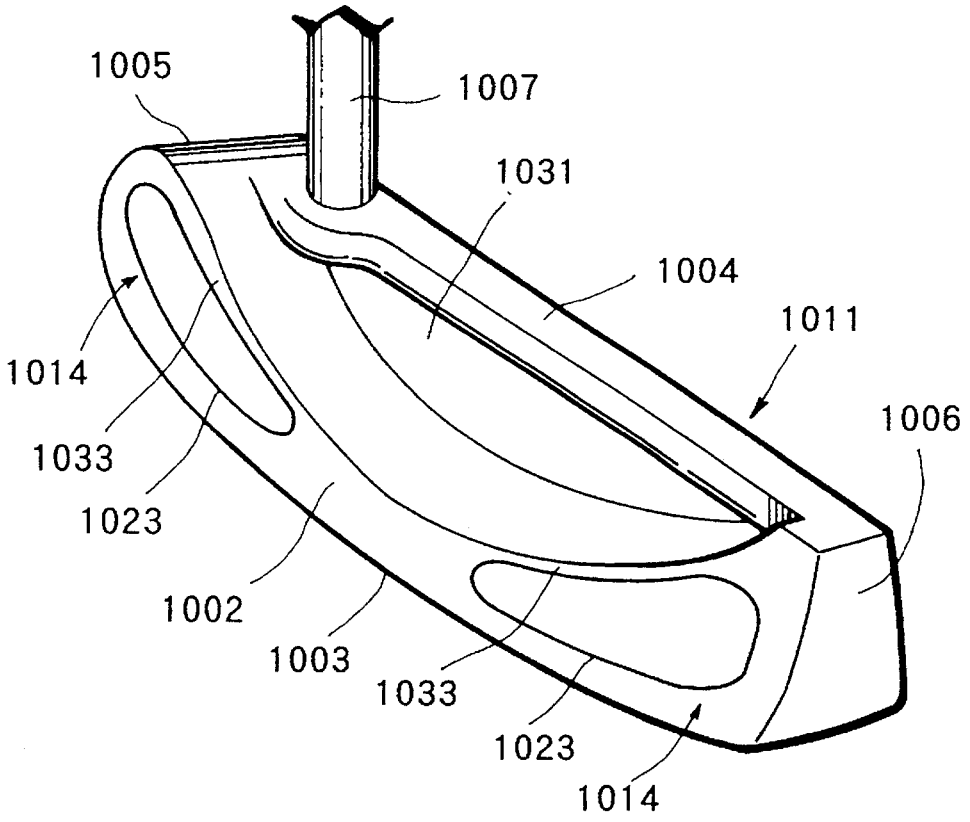
FIG. 17 is a perspective view showing a tenth embodiment of a golf club head of the invention.

In FIG. 17 showing a tenth embodiment of the invention, the above-mentioned structures described in fourth to ninth embodiments are applied to a putter golf club head. In a back 1002 adjacent a sole 1003 side of a head body 1011 are provided two weights 1014, one of which is provided at a heel 1005 side, while the other at a toe 1006 side. Thereafter, between the weights 1014 is formed a cavity 1031.

Figure 18:
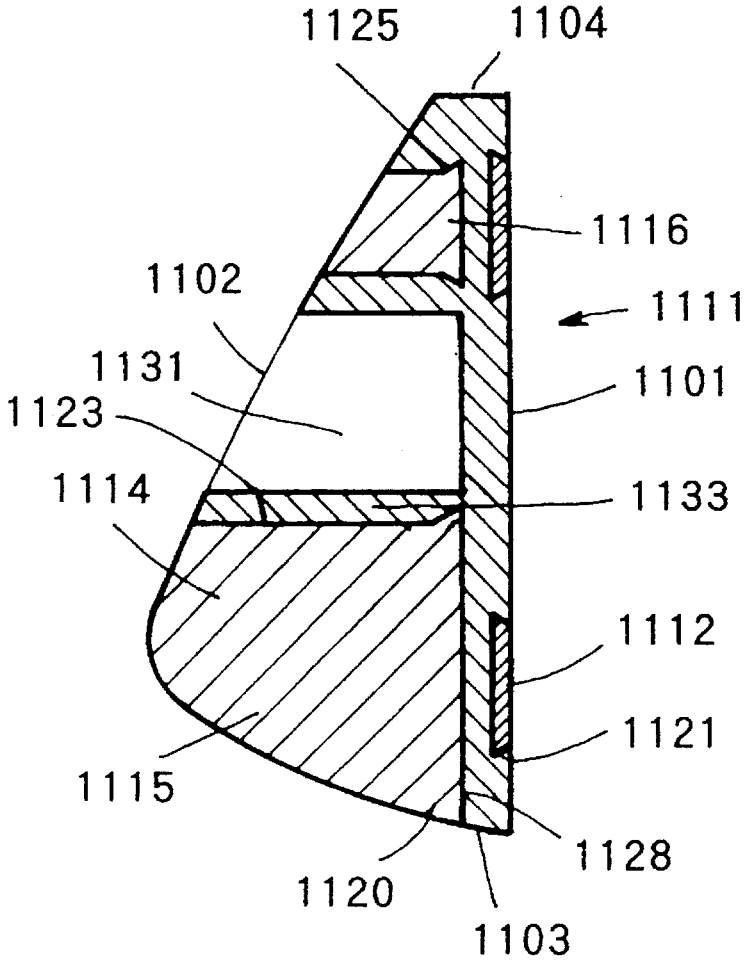
FIG. 18 is a transverse section showing an eleventh embodiment of a golf club head of the invention.
Figure 19:
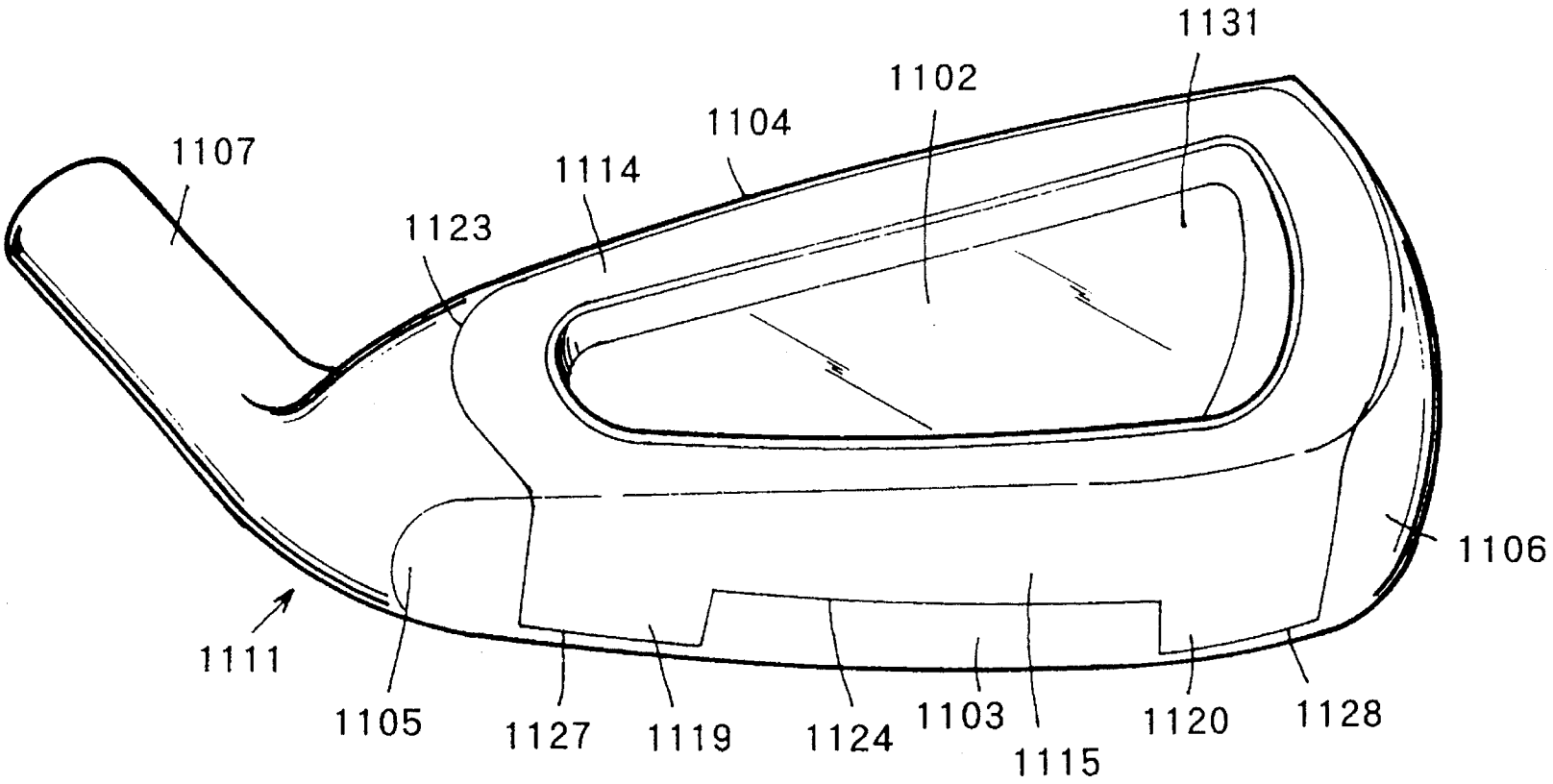
FIG. 19 is a perspective view showing an eleventh embodiment of a golf club head of the invention.

In FIGS. 18 to 19 showing an eleventh embodiment of the invention, a weight 1114 at a back 1102 side is structured as shown in a fourth embodiment, while a weight 1112 at a face 1101 side is structured as shown in a seventh embodiment, thereby disclosing a combination structure of the above two embodiments. In addition, in an eleventh embodiment, an extension 1124 of an embedding groove 1123 provided at a back 1102 side for fitting the weight 1114 thereinto has recesses 1127,1128 extending respectively from each end of a heel 1105 and toe 1106 side toward a face 1101. On the other hand, a weight-sole portion 1115 provided at a back 1102 side of the weight 1114 has each protrusion 1119,1120 corresponding to each recess 1127,1128.

As the weight-sole portion 1115 provided at a back 1102 side of the weight 1114 has greater width at the toe 1106 and heel 1105 side in an eleventh embodiment, the weight of a club head can be distributed to the toe 106 and heel 1105 sides, thereby further enlarging a sweet area.

Figure 20:
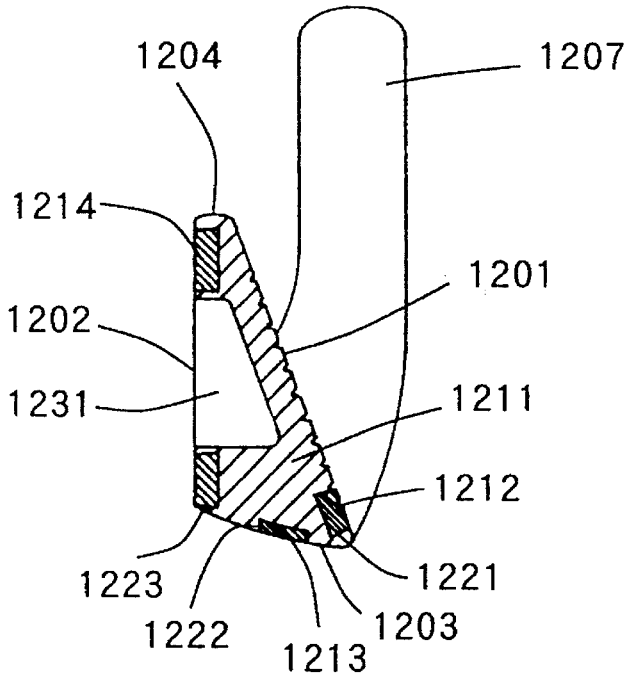
FIG. 20 is a transverse section showing a twelfth embodiment of a golf club head of the invention.
Figure 21:
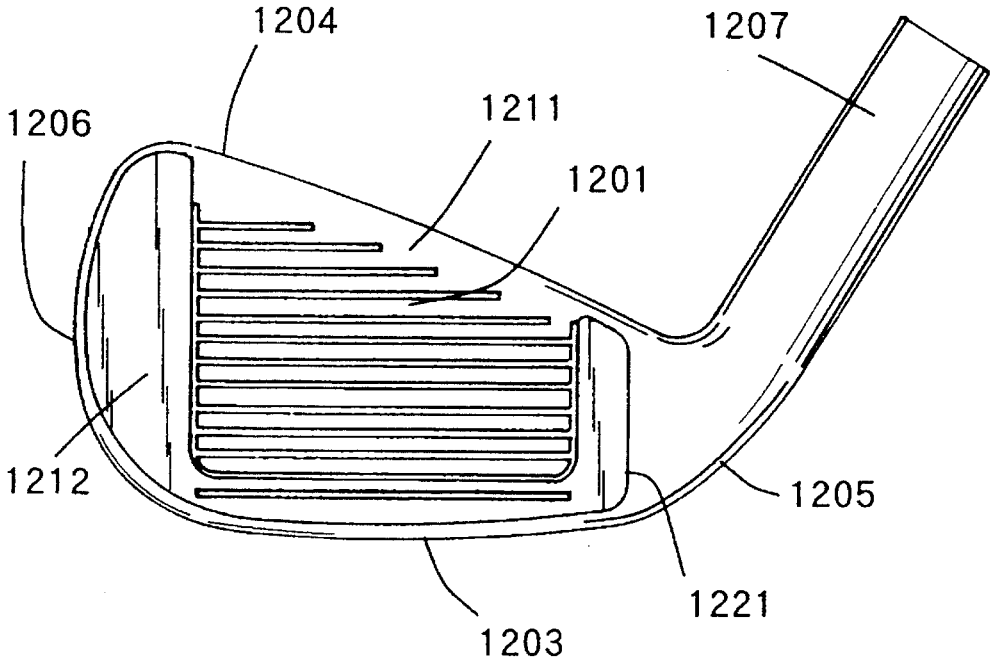
FIG. 21 is a front view showing a twelfth embodiment of a golf club head of the invention.
Figure 22:
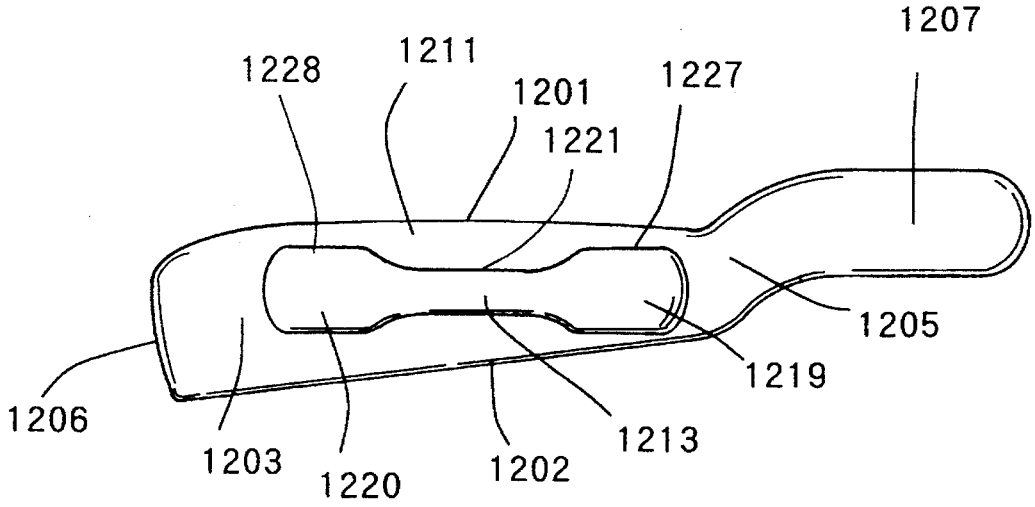
FIG. 22 is a bottom plan view showing a twelfth embodiment of a golf club head of the invention.

In FIGS. 20 to 22 showing a twelfth embodiment of the invention, there is provide a weight 1212 at a face 1201 side, which is independent of a weight 1214 provided at a back 1202 side, and there is provided a weight 1213 at a sole 1203 side similar to a first embodiment. The weight 1213 has widened portions 1219,1220 at the heel 1205 and toe 1206 sides relative to its intermediate portion. Although the weight 1214 at the back 1202 side is formed annular, the weight 1212 at the face 1201 side is formed semi-annular, provided along the toe 1206, sole 1203 and heel 1205 side respectively, not provided at the top 1204 side.

Typically, an iron golf club head is thickened at a sole 1203 side than at a top 1204 side. therefore, it is difficult to provide sufficiently thickened weights 1212,1214 at both sides of the face 1201 and back 1202 of the top 1204 side. According to a twelfth embodiment, the weight 1214 is not provided at the face 1201 side, but only at the back 1202 side of the top 1204 side of the head body 1211, thereby effecting the further backward positioning of the center of gravity of a whole club head, which is advantageous for enlarging a sweet area.

Figure 23:
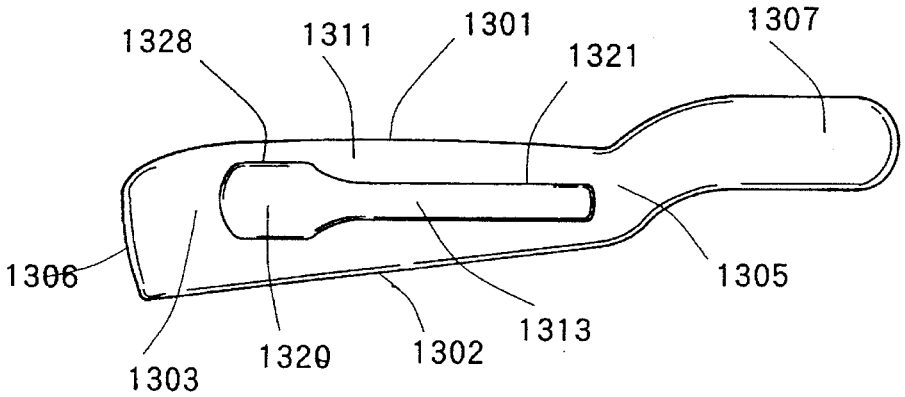
FIG. 23 is a bottom plan view showing a thirteenth embodiment of a golf club head of the invention.
Figure 24:
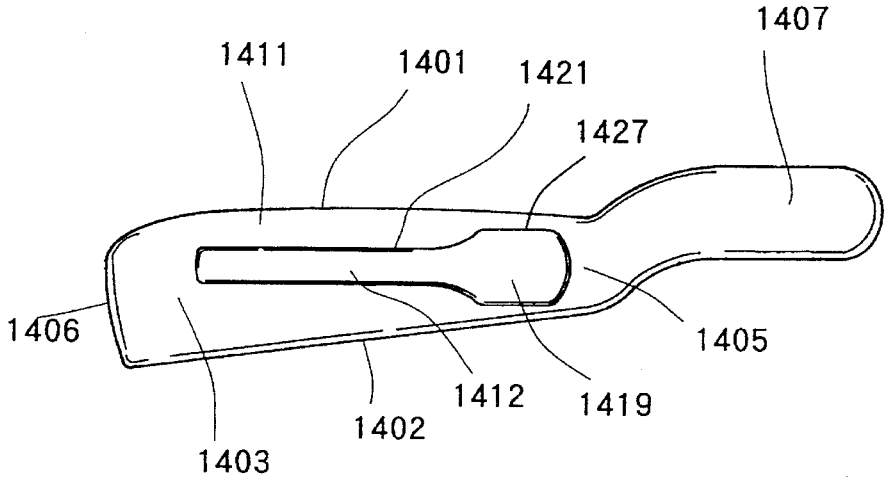
FIG. 24 is a bottom plan view showing a fourteenth embodiment of a golf club head of the invention.

Further, to enlarge a sweet area and lower the center of gravity of a club head, the weight 1213 at the sole 1203 side is provided independently both of the weight 1214 at the back 1202 side and the weight 1212 at the face 1201 side, thus increasing an adjustability of configurations of the weight 1214 at the sole 1203 side in fabrication thereof. For example, such an adjustability can be shown such that as described in a twelfth embodiment, the weight 1213 may have widened portions 1219,1220 at the heel 1205 and toe 1206 side, or as in a thirteenth embodiment shown in FIG. 23, there may be provided a weight 1313 having a widened portion 1320 only at a toe 1306 side, or otherwise, as in a fourteenth embodiment shown in FIG. 24, there may be provided a weight 1413 having a widened portion 1419 only at a heel 1405 side.

According to a thirteenth embodiment, the weight 1313 adjacent the sole 1303 is widenend at the toe 1306 side than at the heel 1305 side in order that the weight distribution of a club head may be shifted toward the toe 1306 side, thereby supplying a golf player who tends to "slice" a ball with a suitable golf club head. Reversely, according to a fourteenth embodiment, the weight 1413 adjacent the sole 1403 is widenend at the toe 1406 side than at the heel 1405 side in order that the weight distribution of a club head may be shifted toward the heel 1405 side, thereby supplying a golf player who tends to "hook" a ball with a suitable golf club head.

In addition, the center of gravity of a club head can be further positioned backward and low by integrating the weight-sole portion 415 with the weight 414 at the back 402 side, as having shown in a fourth embodiment, whereby reducing the number of components and the cost of its fabrication.

As descrived in the above-mentioned embodiments, suitable adjustmemnts of the configurations and/or positions of weights and the sizes of the cavity permit an optional setting of the weight distribution of a club head in fabrication thereof.

Incidentally, each structure described in each above-mentioned embodiment can be applied not only to an iron golf club head, but to a putter golf club head.

What is claimed:

1. A golf club head comprising:

a head body having a face, a sole and a back;

one or more balance weights formed of a material denser than that of said head body, said balance weight being linearly disposed along a peripheral portion of the face of said head body.

2. A golf club head according to claim 1, wherein said balance weights are formed annular.

3. A golf club head according to claim 2, wherein said head body is hollow.

4. A golf club head according to claim 2, further comprising:

a concave cavity provided in the back of said head body;

a separate balance weight provided at the sole of said head body.

5. A golf club head according to claim 2, wherein said balance weights are fitted into the peripheral portion of the face by a mortise and tenon joint.

6. A golf club head according to claim 2 further comprising score lines defined on said face, and wherein said balance weights are disposed, surrounding said score lines.

7. A golf club head according to claim 1, wherein said balance weights are each formed semi-annular, said balance weights being fitted into grooves provided at four corners of the peripheral portion of the face.

* * * * *